United States Patent [19]

Grosse et al.

[11] Patent Number: 4,519,234

[45] Date of Patent: May 28, 1985

[54] DEVICE FOR MANUFACTURING LAMINATED SEMIFINISHED MATERIAL

[75] Inventors: Joachim Grosse, Erlangen; Heinrich Hässler, Wendelstein; Günter Tiefel, Fürth, all of Fed. Rep. of Germany

[73] Assignee: Siemens Aktiengesellschaft, Berlin and Munich, Fed. Rep. of Germany

[21] Appl. No.: 513,075

[22] Filed: Jul. 12, 1983

[30] Foreign Application Priority Data

Aug. 9, 1982 [DE] Fed. Rep. of Germany ..... 3229626

[51] Int. Cl.[3] ..... B21C 23/22

[52] U.S. Cl. ..... 72/258; 72/467

[58] Field of Search ..... 72/258, 261, 273.5, 72/467; 425/79, 461

[56] References Cited

FOREIGN PATENT DOCUMENTS 1539848 4/1971 Fed. Rep. of Germany .
2848980 5/1980 Fed. Rep. of Germany .
2952128 6/1981 Fed. Rep. of Germany .
880583 10/1961 United Kingdom .
555930 4/1977 U.S.S.R. ..... 72/258

OTHER PUBLICATIONS

F. J. Zilges, "Hauptkriterien bei der Auslegungeiner Strangpressanlange für Schwermetall," *Metall*, vol. 36, No. 4, Apr. 1982, pp. 439–443.

Horst Schreiner, *Pulvermetallurgie Electrischer Kontakte*, Springer Verlag, 1964, pp. 211–213.

*Primary Examiner*—Lowell A. Larson
*Assistant Examiner*—Jorji M. Griffin
*Attorney, Agent, or Firm*—Kenyon & Kenyon

[57] ABSTRACT

A device for manufacturing a laminated semifinished material by indirect extrusion of a sintered-bond blank consisting of layers of metal, metal alloys, metal mixtures or mixtures of metals and nonmetals comprises a vessel with a rectangular cutout or extrusion chamber and a one- or multipart extrusion die with one or several cutouts. A surface of the die facing the blank is profiled in the form of one or more roof gables, the surfaces of which gable forms extend perpendicularly towards the cutout from a sliding surface of the extrusion die.

10 Claims, 2 Drawing Figures

DEVICE FOR MANUFACTURING LAMINATED SEMIFINISHED MATERIAL

BACKGROUND OF THE INVENTION

This invention relates to a device for manufacturing by indirect extrusion laminated semifinished material from a layered sinter-bond blank, the layers of which blank consist of metal, metal alloys, metal mixtures or mixtures of metals and nonmetallic substances. The indirect extrusion device comprises a vessel with a rectangular cutout and an extrusion die of one or more parts with one or more cutouts.

Contacts for low-voltage air switchgear usually consist of silver base materials to which metaloids or metal oxides are added for reducing the welding power and for improving the burnoff behavior. These material additives make the formation of a welded or soldered bond with a support part more difficult. For this reason, the contacts are frequently provided with a second solderable or weldable layer.

If contacts are fabricated by initially extruding single-layer strips from sintered blanks as semifinished material, the initially single-layer extrusions must be coated, after suitable and often elaborate pretreatment, with the solderable layer and subsequently cut into contacts. Thus, as described in German Open Patent Application (Deutsche Offenlegungsschrift) No. 2,848,980, an auxiliary plating layer may be applied and subsequently plated by hot rolling and rolled to proper dimensions. Especially with distinctly brittle materials such as Ag-$SnO^2$, the use of which materials facilitate control of environment pollution, difficulties arise in plating by hot rolling, with the result that the usual oxide contents are limited to 10 to 12% by weight because of decreasing deformability with increasing oxide contents. To improve the deformation properties of materials, the starting powders are subjected to additional annealing and granulating treatments, as described in German Open Patent Application (Deutsche Offenlegungsschrift) No. 2,952,128.

It has furthermore been attempted to produce plating during the extrusion process by simultaneously extruding the contact material with the metal of the solderable layer. British Pat. No. 880,583 described a method which images the layer geometry of the blank in the extrusion to scale by extruding a multilayer sintered-bond part. In fabricating the blank, a support web is inserted into the powder pressing die in such a manner that it represents a scale image of the desired boundary layer geometry of the extrusion. The powder chambers so produced are filled to the same height with respective powders, the partition is removed and the powders are pressed together in a pressure direction parallel to the powder boundary layer. The pressed part produced in this manner is subsequently sintered and then extruded, the direction of pressure being again parallel to the boundary layer. Strength problems at the boundary layer arise here due to the usually different densifiabilities of the different powders.

As disclosed in German Patent Document (Deutsche Auslegeschrift) No. 1,539,848, the strength of boundary layers produced by this "imaging" method can be improved if the partition inserted into the powder pressing tool is serrated at the bottom, so that the powders are mixed at the boundary layer when this partition is pulled out. This mixture of the powders, however, leads to an undesirably wider transition zone between the different materials.

Both these methods (the rolling method and the "imaging" method) use the direct extruding process, usually called "extruding", in which the batch to be extruded is pushed through the tool in the forward direction, i.e., in the direction of motion of the pressing element. The friction force between the extruded material and the vessel wall, which initially can be up to twice the deformation force proper, is reduced considerably with the shortening of the remaining batch, with the consequence that the layer geometry and the layer thickness shift or change over the length of the extrusion. Because the friction conditions are different from extrusion to extrusion, this effect cannot be compensated by making the boundary layer in the pressed powder part wedge-shaped. A further disadvantage of direct extrusion is the large amount of return material, which is in general more than 10% ("Metall" vol. 36 (1982) no. 4, pages 439 to 443). This ratio is further increased in the extrusion of laminated sintered-bond parts because at the start of the extrusion a considerable running-in region occurs until the different layers flow to the die opening and instantaneous equilibrium conditions can settle there. The equilibrium, however, is shifted again over the length of the extrusion with the change of wall friction. In this direct extrusion method, only a material discharge of less than 70% can be expected.

These known methods have not found acceptance because of problems with layer thickness tolerance, strength of the boundary layers and lower yield.

The two-layer powder pressing technique for manufacturing finished formed parts has proven successful in solving these problems. In this technique laminated parts comprising, for instance, one layer of contact material and another layer of solderable material are produced by filling a compacting chamber with the powder layers one on top of the other and subsequently pressing the layers together. The direction of the pressure is in this case perpendicular to the boundary layer so that different densification behavior of the powders during the pressing has no disturbing effect on the strength of the boundary layer (see "Pulvermetallurgie elektrischer Kontakte" ("Powder Metallurgy of Electrical Contacts"), Springer-Verlag, Berlin 1964, pages 211 to 213).

This two-layer powder pressing method is limited to small parts and, in particular, does not allow the use of high degrees of deformation for densifying and increasing the strength of the pressed powder parts, which limitation leads to special vulnerability of the two-layered materials to mechanical, thermal and electrical stresses.

An object of the present invention to develop an improved device for producing, in a simple manner and without additional plating operations, laminated semifinished material by indirect extrusion of a sintered-bond blank having layers of metal, metal alloys, metal mixtures or mixtures of metallic and nonmetallic substances. Another object of this invention is to produce such a device in which extruded multilayered materials have a layer thickness uniform over the length and the cross section of the extrusion and in which there is great adhesion of the layers to each other, as well as high material utilization.

SUMMARY OF THE INVENTION

According to the invention, these objects are attained in a device of the aforementioned type by the provision that the surface of the die facing the blank is provided at least in part with a height profile up to the die cutout in such a manner that the different layers of the blank develop with a predetermined thickness distribution over the cross section of the extrusion. A design of the height profile in the form of a roof gable, in which the upper boundary is centered with respect to the die cutout, has proven particularly advantageous.

Surprisingly, it has been found that such a layered semifinished material can be produced by the multilayer extrusion technique. For this purpose, a blank is made as a simple slab of flat powder layers, like in two-layer powder pressing techniques and is extruded in a vessel with rectangular or square cutout indirectly by means of a die according to the present invention. By making the die in accordance with the invention, the flow of the material is controlled so that the layers have a uniform thickness over the width of the extrusion even if no exact image is present in the blank.

DETAILED DESCRIPTION

Figure 1:
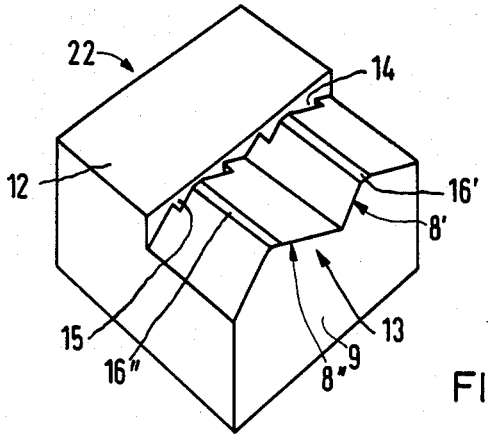
FIG. 1 is a perspective view of an extrusion die according to the present invention.

As illustrated in FIG. 1, an extrusion die 22 for use in an indirect extruder (see FIG. 2) for producing multilayered semifinished strips not shown) comprises, in accordance with this invention, a prism having on one side (a) a contact surface 12 for engaging a multilayered blank 10 (see FIG. 2) disposed in a chamber of an extrusion vessel 21 during an extrusion operation, and (b) a profiled flow-control surface 13 for ensuring that different layers of blank 10 are guided to cutouts or channels 14 and 15 in die 11 in such a manner as to produce layers of uniform and predetermined thickness in extruded sections or strips. Profiled surface 13 extends up to cutouts 14 and 15, i.e., profiled surface 13 occupies at least an area bounded on an inner side or periphery by cutouts 14 and 15 and on an outer periphery by a side or surface 9 of the extrusion die oriented perpendicularly to contact surface 12.

Profiled surface 13 extends perpendicularly from die side 9 such that an orthographic projection of the profiled surface onto a plane defined by die side 9 is a line comprising a multiplicity of connected line segments. Profiled surface 13 is advantageously in the form of a roof gable or a plurality of of adjoining roof gables 8' and 8'' each having a peak or upper limitation 16' and 16'' which is advantageously centered with respect to a respective die cutout or channel 14 and 15. Each roof gable 8' and 8' of profiled surface 13 comprises a plurality of planar surface sections inclined with respect to one another and disposed perpendicularly to die surface 9.

Figure 2:
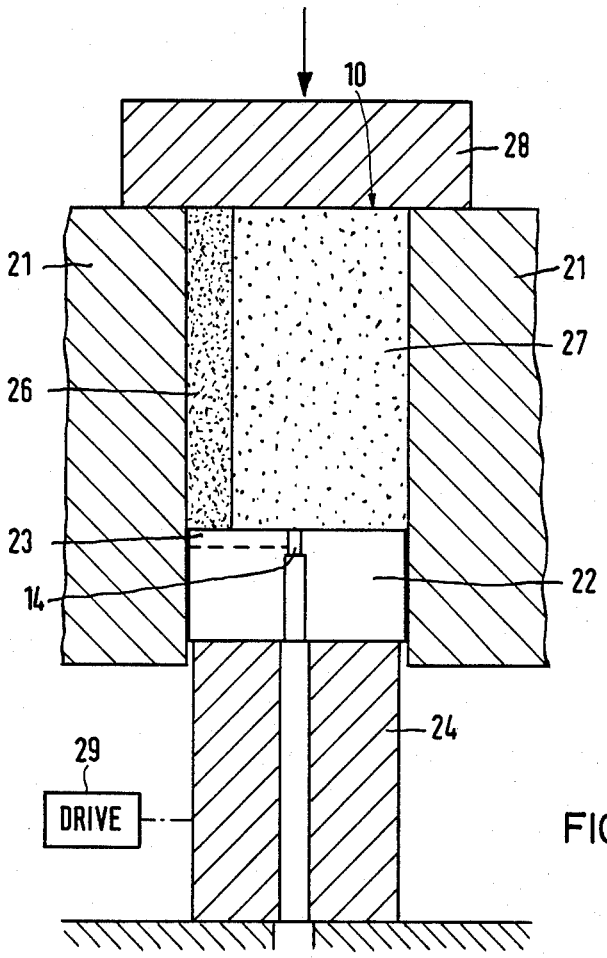
FIG. 2 is a schematic cross-sectioned view of an indirect extrusion device with a die according to the present invention, showing a two-layered blank.

As illustrated schematically in FIG. 2, a device for indirect extrusion of multilayered strips (not shown) by means of die 22 includes an extrusion vessel 21, a pressure piece 28, and a hollow plunger 24. At the beginning of an extrusion operation, blank 10 is inserted into a chamber or cutout in vessel 21, while pressure piece 28 is brought to bear against one side of the blank and die 22, with a height profile 23 defined by profiled surface 13, is placed into contact with an opposite side of the blank. Blank 10 comprises, for example, a solderable silver layer 26 and a silver-tin oxide layer 27.

Upon the disposition of pressure piece 28 and die 22, as well as the engagement of plunger 24 with die 22, the plunger is pushed into the extrusion vessel chamber by a drive 29. Extruded strips leave the extrusion chamber of vessel 21 through die cutouts 14 and 15 (only cutout 14 is shown in FIG. 2) and through hollow plunger 24. In indirect extrusion presses such as that schematically illustrated in FIG. 2, there is a homogeneous flow of material without friction at the vessel wall and with the lowest possible extrusion residue. If die 22 did not have profiled surface 13 and were, for instance, in the form of a single plane, a crowned shape of the silver layer would be obtained over the width of the extrusion because the imaging is then to scale. Designing die 22 in accordance with the present invention, however, produces a uniformly thick layer. Two-layer extrusions with high uniformity of layer thickness are obtained in the present case. Since extrusion residue and the material loss occurring due to the equilibrium adjustment of the layers at the start of the extrusion are independent of the length of the blank, the relative yield improves if the blank is made as long as possible. In a blank which is about approximately three times as long as it is thick, a yield of 90% of a two-layer extrusion with true dimensions has been obtained. In $AgSnO^2$ contacts cut from such extrusions with oxide contents of 10 and 17% by weight, no cracks occur at the boundary layer between the contact material and the silver layer under the high thermal and mechanical stresses generated in the material during electrical switching tests in a-c contactors, which results confirm the high boundary layer strength of two-layer extrusion material produced by means of a die in accordance with this invention.

For comparison, $AgSnO^2$ materials produced by the extrusion/roll plating technique have an oxide content only of about 10 to 12% by weight due to the poor deformation properties in rolling.

What is claimed is:

1. In a device for manufacturing by indirect extrusion a laminated semifinished material having a plurality of layers each consisting at least partially of a metal, said device comprising a vessel with a rectangular chamber and an extrusion die with at least one cutout, said die being insertable into said chamber and having on one side a contact surface engageable with a multilayered blank disposed in said chamber during an extrusion operation, said cutout extending from the side of said die bearing said surface, the improvement wherein:

the die is provided, on the side facing the blank in the vessel chamber during an extrusion operation, with flow control means for ensuring that different layers of said blank are guided to the die cutout in such a manner as to produce layers of uniform and predetermined thickness in an extruded section, said flow control means including a profiled surface of said die occupying at least an area bounded at an inner periphery by said cutout and at an outer periphery by a side of said die oriented substantially perpendicularly to said contact surface.

2. The improvement defined in claim 1 wherein an orthographic projection of said profiled surface onto a plane defined by the side of said die oriented substantially perpendicularly to said contact surface is a line.

3. The improvement defined in claim 2 wherein said profiled surface includes a plurality of planar surfaces inclined with respect to one another and disposed perpendicularly to the side of said die oriented substantially perpendicularly to said contact surface.

4. The improvement defined in claim 3 wherein said profiled surface is at least in part in the form of a roof gable.

5. The improvement defined in claim 4 wherein said roof gable has a peak centered with respect to said cutout.

6. The improvement defined in claim 1 wherein said profiled surface is at least in part in the form of a roof gable.

7. The improvement defined in claim 6 wherein said roof gable has a peak centered with respect to said cutout.

8. In a device for manufacturing by indirect extrusion a laminated semifinished material having a plurality of layers each consisting at least partially of a metal, said device comprising a vessel with a rectangular chamber and an extrusion die with at least one cutout, said die being at least partially insertable into said chamber and having on one side a contact surface engageable with a multilayered blank disposed in said chamber during an extrusion operation, said cutout extending from the side of said die bearing said surface, the improvement wherein:

the side of the die bearing the contact surface is provided at least partially with a profiled portion, bounded on one side by the die cutout, in such a manner that the different layers of the blank are developed with a predetermined thickness distribution over an extrusion cross section.

9. The improvement defined in claim 8 wherein said profiled portion has at least in part the form of a roof gable.

10. The improvement defined in claim 9 wherein said roof gable has a peak centered with respect to said cutout.

* * * * *